US005730286A

United States Patent [19]

Eska

[11] Patent Number: 5,730,286

[45] Date of Patent: Mar. 24, 1998

[54] CONTAINER WITH A PRESSURE VESSEL FOR REGENERATING AND STORING TENNIS BALLS

[76] Inventor: Peter Eska, Buchener Strasse 69, 68259 Mannheim, Germany

[21] Appl. No.: 318,793

[22] Filed: Oct. 13, 1994

Related U.S. Application Data

[63] Continuation-in-part of PCT/DE93/00331, Apr. 13, 1993.

[30] Foreign Application Priority Data

Apr. 14, 1992 [DE] Germany ..... 42 12 419.0

[51] Int. Cl.[6] ..... B65D 85/00

[52] U.S. Cl. ..... 206/315.9; 206/315.1; 206/526

[58] Field of Search ..... 206/315.9, 315.91, 206/315.1, 526; 137/857; 215/390

[56] References Cited

U.S. PATENT DOCUMENTS

| | | | |
|---|---|---|---|
| 3,888,347 | 6/1975 | Kramer | 206/315.9 |
| 4,019,629 | 4/1977 | Dubner et al. | 206/315.9 |
| 4,101,029 | 7/1978 | Feinberg et al. | 206/315.9 |
| 4,161,247 | 7/1979 | Feinberg et al. | 206/315.9 |
| 4,428,478 | 1/1984 | Hoffman | 206/315.9 |
| 5,014,848 | 5/1991 | Wild et al. | 206/315.9 |

FOREIGN PATENT DOCUMENTS

| | | | |
|---|---|---|---|
| 4106374 | 9/1992 | Germany | 206/315.9 |

*Primary Examiner*—David T. Fidei
*Attorney, Agent, or Firm*—Horst M. Kasper

[57] ABSTRACT

A container (1, 1', 28) has a pressure vessel for regenerating and storing tennis balls (21, 21') under a positive gas pressure, preferably a positive air pressure. The container has a bottom (3, 20, 35) and a pressure-tight lid (3', 4, 31, 31') with an inlet valve (24, 24') and a gas pump (8, 8', 34) linkable thereto. The gas pump (8) is constructively integrated inside the pressure vessel (2, 30, 30') or the container (1, 1', 28). A removable receptacle (12) made of several mutually detachable parts (13, 14) is inserted into the pressure vessel (2). The receptacle contains mutually separated recesses (15, 16) having substantially the size of tennis balls (21, 21') and interconnected by means of the inlet valve (24, 24') in such a way that gas can flow from one recess into another recess. The recesses (15, 16) are located within the parts (13, 14) that constitute the receptacle (12) and which make up chambers (15, 16) for tennis balls when the molds are aligned and assembled. An positive pressure may be applied on the tennis balls (21, 21') disposed in the chambers (15, 16) by means of the gas pump (8, 8'). A pressure relief valve (7, 7') and an outlet valve (6, 6') are integrated in the lid (3, 3') of the container and are in communication with the pressure vessel (2, 2') inside the container.

24 Claims, 5 Drawing Sheets

CONTAINER WITH A PRESSURE VESSEL FOR REGENERATING AND STORING TENNIS BALLS

CROSS-REFERENCE TO RELATED APPLICATIONS

This application is a continuation-in-part application of another international application filed under the Patent Cooperation Treaty on Apr. 13, 1993 and bearing Application No. PCT/DE93/00331. The entire disclosure of this latter application, including the drawings thereof, is hereby incorporated in this application as if fully set forth herein.

BACKGROUND OF THE INVENTION

1. Field of the Invention

The present invention relates to a container with a pressure vessel for the regeneration and storage of tennis balls under a positive pressure, preferably a positive air pressure, with a bottom and an easily opened and closed pressure-tight cover, with a pressure relief valve as well as an outlet valve, which are connected with the pressure vessel of the container, with an inlet valve as well as with a gas pump attachable to the inlet valve.

2. Brief Description of the Background of the Invention Including Prior Art

Tennis balls lose internal pressure over the course of time, because their rubber envelope is not absolutely gas-tight. As a result of the pressure loss, the elasticity of such tennis balls is anything but satisfactory. Tennis players refer to these balls as "heavy" or "soft." Depending on the quality of the rubber envelope and on the storage conditions, the internal pressure gradually sinks until the respective ball becomes unusable for further playing. For this reason, an effort is made to keep the internal pressure of the tennis ball as constant as possible or, respectively, to restore it again to a sufficient level.

The German Patent Document DE 89 08 826.3 U1 discloses a pressure box for tennis balls that consists of a cylindrical pressure vessel with a bottom and a lid. An inlet valve and an outlet valve for compressed gas as well as a manometer for measuring the internal pressure are provided. A drawback of this construction includes that a supplementary pressure-gas tank for -compressed gas is required for the operation. The superposing of the tennis balls on top of one another in the container is also a drawback with respect to the shape of the tennis balls, which can thereby lose their spherical shape.

The German Patent document DE-G 91 10 330.4 U1 discloses a container for storing tennis balls under positive gas pressure. The container exhibits a lid with a closing device and includes at least one valve, through which valve the container is filled by means of a gas pump and through which the pressure above atmospheric pressure can be released again as required. The pump generating the positive gas pressure can be fixedly connected to the container. The gas-tight closing device of the container lid is a screw cap or a bayonet lock.

The German Patent document DE 37 07 466 C2 discloses a compressed-air packaging cylinder for tennis balls. The packaging cylinder consists of a cylindrical. Jacket part with a screwing thread, a locking cap screwed down onto a rubber gasket, and spacer rings in the Jacket part. A bellows, equipped with an internal return spring, is arranged in one piece with a closed, height-adjustable bottom at the lower end of the cylindrical Jacket part, and a rotating flange adapter is attached via an outer pleat connection of the bellows. In the compressed state of the bellows, the flange adapter captures a level stabilizer with engaging and locking openings for adapter balls of the adapter flange.

The German Patent document DE-G 87 07 231.9 U1 discloses a container for holding at least one tennis ball, whereby an air valve Joins into the storage space and a pump is attached at the container on the outside of the container. The pump is capable of generating a positive pressure inside the container through the air valve.

The German Patent document DE 88 15 577.3 U1 discloses a storage container for tennis balls that consists of a cylindrical pressure vessel for holding a plurality of tennis balls stacked one on top of the other, whereby a piston pump is disposed at the vessel outside of the pressure vessel with a line leading into the container for the generation of an overpressure, or, a pump is situated in the cover and acts within the pressure vessel to generate a certain overpressure by means of a single stroke. A pressure gauge as well as a safety or pressure relief valve can be arranged within the cover. Furthermore, an elongated receptacle is disposed inside the container, where the receptacle exhibits recesses for receiving the individual tennis balls one on top of the other, in order to reduce the air volume within the container. However, the tennis balls touch one another at points within the receptacle and lie one on top of the other.

The U.S. Pat. document No. 4,161,247 relates to a pressureless container for holding a plurality of tennis balls, which are kept under pressure by means of a receptacle consisting of several parts. Here the holding spaces of the receptacle for the tennis balls are slightly smaller than the tennis ball, which is thereby mechanically compressed when the receptacle is pressed together. Such a container, which only compresses tennis balls mechanically, is not suitable for regenerating tennis balls which have lost part of their overpressure. The U.S. Pat. document No. 3,415,357 relates to a pressurized gas container for tennis balls with receptacles in which the tennis balls are embedded.

The U.S. Pat. document No. 3,889,807 to Feinberg et al. relates to a means for preserving tennis balls or the like, where a gas-pressurized ball is packaged under pressure.

The German Patent document No. 4,001,610 A1 to Hogh relates to a pressure-proof closable container for a plurality of balls, where the tennis balls are disposed within the space of the container, and wherein the space of the container can be pressurized.

The French Patent document No. 2,596,359 to Souvignet et al. relates to a packaging for playing balls of the type of a tubular body formed by a membrane of a transparent synthetic material and by two caps for closing the two ends of the tubular body.

The German Petit Patent document No. 87 02 822.0 relates to device for the storing of tennis balls under pressure in a container having a cylindrical-shaped jacket with a bottom and an air-tight cap. An air pump is disposed at the outside of the container and is connected to the container.

The U.S. Pat. document No. 5,002,196 to Bassili relates to a pressure vessel with removable sealing lid for the storing of tennis balls. The tennis balls are placed within the space in the pressure vessel.

The International Patent Document WO 90/01973 to Egloffstein et al. relates to a device for storing tennis balls under pressure. The piston pump for pressurizing the tubular container is disposed outside of the tubular container.

SUMMARY OF THE INVENTION

1. Purposes of the Invention

It is an object of the present invention to provide for the improving of a device of the above-mentioned kind in such a way that the use of a supplementary tank for compressed gas or an external pump is unnecessary or, respectively, no projecting parts are arranged at the container housing, but instead a structurally compact arrangement is chosen, where the pump cannot be lost and is protected against damage, and the storage of tennis balls within the container under pressure occurs without loss of shape and without the balls exerting influence on one another.

It is another object of the present invention to provide a storage container for tennis balls of a compact nature and of a reliable and convenient construction.

It is yet another object of the present invention to provide a container for tennis balls, which is constructed to maintain the spherical shape of the tennis balls and to maintain or restore the internal pressure of the tennis balls.

This and other objects and advantages of the present invention will become evident from the description which follows.

2. Brief Description of the Invention

According to the present invention, there is provided a container with chambers for regeneration and storage of tennis balls under positive gas pressure. A pressure vessel is closed at a base end by a base and has another end for easy opening and closing of the pressure vessel. The base end and the other end represent a first end and a second end. A cover is disposed at the first end of the pressure vessel. A pressure relief valve is disposed in the cover and is connected to the pressure vessel. An outlet valve is disposed in the cover and is connected to the pressure vessel. An inlet valve is connected to the pressure vessel. A gas pump is attached to the inlet valve. The gas pump is arranged in a structurally integrated manner. The gas pump generates a positive pressure of a gas. A first detachable part has a first set of recesses and is disposable in the pressure vessel. A second detachable part has a second set of recesses and is disposable in the pressure vessel. The first detachable part and the second detachable part form a removable receptacle to be disposed inside of the pressure vessel. The first set of recesses together with the second set of recesses form chambers of the receptacle, with each chamber having a size of a tennis ball, for holding a plurality of tennis balls in the chambers inside of the receptacle, with individual tennis balls separated from each other. Said chambers are separated from each other. Communication means are connected to said chambers such that said chambers communicate with one another with respect to the gas. The positive pressure is applied through the chambers to the tennis balls.

The pressure vessel comprises two pressure chambers. A connecting channel can connect the two pressure chambers to each other. The pressure chambers can communicate through the connecting channel with respect to the gas. The gas pump can be disposed between the two pressure chambers. The cover can be provided as a pressure-tight cover for a first one of the two pressure chambers. A second pressure-tight cover can be provided for a second one of the two chambers.

The pressure vessel can consist of a block with three bores. Two bores can be designed as interconnected pressure chambers. The gas pump can be integrated into the third bore.

The pressure vessel can have a cylindrical shape. The receptacle can have a cylindrical shape, where the cylindrical shape of the receptacle exhibits a segmental flattening when viewed in a longitudinal direction. The gas pump can be integrated into the pressure vessel within an area defined by the segmental flattening. The pressure vessel can exhibit an opening in a downward direction at the other end. The pressure vessel can be furnished with threads at its other end. A pressure-tight cover can be furnished with threads matching the threads of the pressure vessel. The opening of the pressure vessel is closable with a pressure-tight cover.

The gas pump can comprise a piston and a cylinder. The cylinder can extend through the base of the pressure vessel in a gas-tight manner. The cylinder of the pump can terminate in the cover. A recess can be disposed on the outer side of the cover. A handle can be attached to the piston of the gas pump. The handle can be disposed swivelable around a piston axis. The handle is collapsible and is lowerable into the recess of the cover. A pressure-tight cover can close the other end of the pressure vessel.

The handle is swivelable by 90 degrees, when rotated out of the recess of the cover. The handle can include a disengageable locking device.

An electric motor can be connected to the gas pump. The gas pump can be disposed within the cover of the container, where the cover can be a gas-tight cover.

A pressure gauge and a pressure regulator can be integrated into the cover of the container and can be connected to the pressure vessel of the container in order to maintain a constant specified pressure.

The first detachable part can be detached from the second detachable part. The receptacle can be made of non-compressible plastic foam exhibiting closed cells.

The first detachable part and the second detachable part can form a first layer. A second removable receptacle can include a first detachable part and a second detachable part. The first detachable part of the second receptacle and the second detachable part of the second receptacle can form a second layer. The first layer and the second layer are stackable one above the other.

Connection devices can be equipped with shut-off valves and can be disposed at the pressure vessel for connecting mobile pressure chambers.

The pressure relief valve and the outlet valve can be structurally combined into a single valve unit.

According to the invention, the objective is achieved in that the gas pump is disposed in a structurally integrated manner inside the pressure vessel or the container. A removable receptacle, consisting of several mutually detachable parts, is disposed in the pressure vessel. Recesses of the size of tennis balls are provided inside the receptacle for holding the balls separately from each other. Said recesses are separated from each other but communicate with one another with respect to the gas via channels or the closing gap of the parts of the receptacle. The recesses communicate with each other with respect to the gas via channels or the closing gap of the parts of the receptacle as well as via the inlet valve. The recesses extend over the parts of the receptacle which, when assembled, Comprise all of the recesses. The positive pressure of the gas can be applied via the recesses to the tennis balls by means of the gas pump. The pressure vessel can consist of at least two chambers, which are connected to each other with respect to the gas via a connecting channel. The gas pump is disposed inside the container between the chambers.

The invention has the advantage that, for the production of positive pressure inside the container, there is required neither an external tank of compressed gas, such as a gas cylinder, nor an external pump, but rather, the gas pump constitutes an integral part of the container and cannot be lost. The gas pump is thus protected to the largest extent possible from external damages and from impurities and dirt. The container and the gas pump advantageously form a structural unit. The storage of tennis balls inside the container is achieved without loss of shape, because the individual balls are separated in the individual recesses provided for them in the receptacle, where the individual recesses border on but do not touch one another, such that the balls are separated from each other. The balls are thus no longer squeezed one on top of another, but instead, the positive gas pressure is able to act uniformly over the entire surface of the balls, such that the balls retain their spherical shape or recover their spherical shape.

The container in accordance with the invention makes it possible to double or triple the lifetime of tennis balls in case of normal playing frequency, i.e., two to three times per week, and thus to increase the economy of their use. Since the balls retain a constant internal pressure through regeneration when they are not in use and thus retain a constant playing quality over a prolonged period of time, the player is not forced to adapt his game constantly to a changing ball quality. After all, in the case of balls that are too soft and exhibit insufficient bounce off the racket, the energy transmitted through the tennis racket to the playing arm and thus the stress and load on the arm are appreciably higher than in case of properly bouncing balls. This can result in excess strain of the joints and tendons, leading up to "tennis elbow." By lengthening the lifetimes of the balls, money for the purchase of new balls is saved. Ultimately, balls that are no longer sufficiently good for playing can be used for producing oil by means of pyrolysis.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
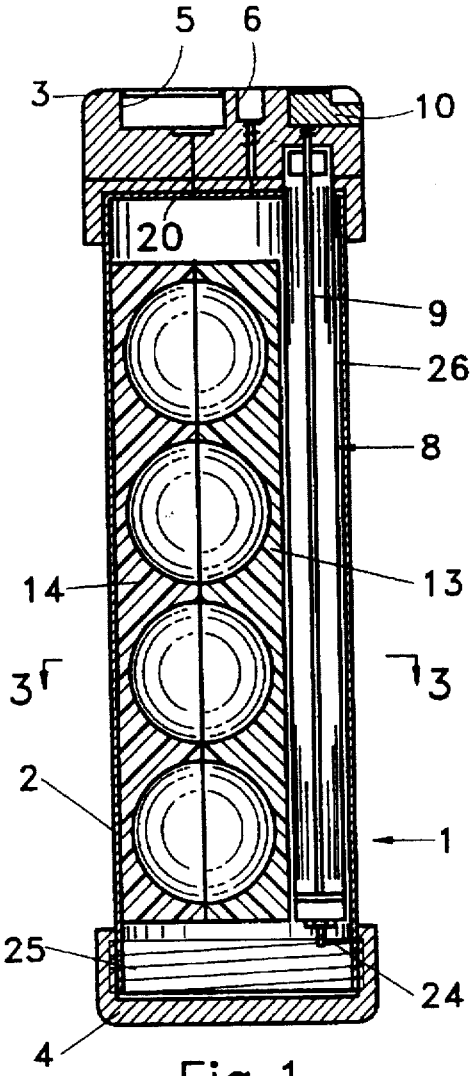
FIG. 1 is a view of a longitudinal section through a container for holding four tennis balls.
Figure 2:
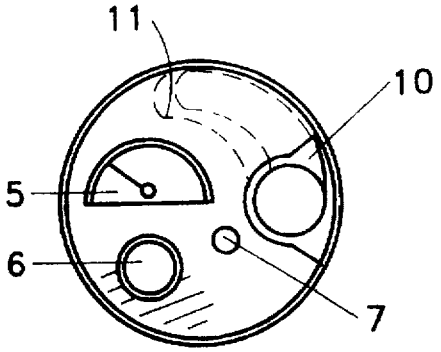
FIG. 2 is a top view onto the container shown in FIG. 1.

The present invention provides for a container 1, 1', 28 comprising a pressure vessel for regeneration and storage of tennis balls 21, 21' under positive gas pressure, preferably positive air pressure. The container 1, 1', 28 includes a base cover 3, 20, 35 and an easily opened and closed pressure-tight cover 3', 4, 31, 31'. A pressure relief valve 7, 7' as well as an outlet valve 6, 6' are connected with a pressure vessel 2, 2' of the container 1, 1', 28. A gas pump 8, 8', 34 is attachable to an inlet valve 24, 24'. The gas pump 8 is arranged in a structurally integrated manner inside the pressure vessel 2, 30, 30' or the container 1, 1', 28. A removable receptacle 12 is disposed inside the pressure vessel 2. The receptacle consists of several mutually detachable parts 13, 14. Recesses 15, 16 of the size of tennis balls 21, 21' for holding the balls separately from each other are disposed inside of the receptacle 12. Said recesses 15, 16 are separated from each other, but communicate with one another with respect to the gas via channels 32 or the closing gap of the parts 13, 14 of the receptacle 12. The recesses 15, 16 communicate with respect to the gas via channels 32 or the closing gap of the parts 13, 14 of the receptacle 12 as well as via the inlet valve 24, 24'. The recesses 15, 16 extend over the parts 13, 14 of the receptacle 12. The parts 13, 14 of the receptacle 12, when assembled, form the recesses 15, 16. The positive pressure of the gas can be applied through the recesses 15, 16 to the tennis balls 21, 21' by means of the gas pump 8, 8'.

The pressure vessel 29 can consists of at least two chambers 30, 30'. The chambers 30, 30' can communicate with respect to the gas through a connecting channel 32. The gas pump 34 can be arranged between the chambers 30, 30' within the container 28.

The pressure vessel can consist of a block with three bores, where two bores are designed as interconnected pressure chambers, and where the gas pump is integrated into the third bore.

The pressure vessel 2 and the receptacle 12 can have cylindrical shapes which, in the longitudinal direction, exhibit a segmental flattening 17. The gas pump 8 can be integrated into the pressure vessel 2 within the flattening 17. The pressure vessel 2 can be open downwardly and can be closed by means of a pressure-tight cover 4, for which purpose the pressure vessel 2 and the cover 4 preferably have threads 25.

The gas pump 8 can consist of a piston 9 with a cylinder 26. The piston 9 can pass through a base 20 of the pressure vessel 2 in a gas-tight manner and can terminate in the base cover 3 of the container 1. The piston 9 of the gas pump 8 can have a handle 10. The handle 10 can be disposed swivelable around a piston axis. The handle 10 is collapsible and can be lowered into a recess 11 within the base cover 3.

The handle 10 is swivelable by 90 degrees when folded out of the recess 11, and can have a detachable engaging device.

The gas pump 8, 8' can be operated electrically and can be disposed within the base cover 3' of the container 1'.

A pressure gauge 5, 5' and a pressure regulator 22 can be integrated into the base cover 3, 3' of the container. The pressure gauge 5, 5' and the pressure regulator 22 can be connected with the pressure vessel 2, 2' of the container in order to maintain a constant specified pressure.

The receptacle 12 can be formed of two parts 13, 13', 14, 14' that can be detached from one another. The receptacle 12 can be made of non-compressible, preferably closed-cell plastic foam.

The receptacle 12 can consist of several layers 13', 14' which can be stacked one above the other, whereby each layer can consist of at least two mutually detachable parts.

Connection devices, equipped with shut-off valves, can be disposed at the container or at the pressure vessel for a connection of additional mobile pressure chambers.

The pressure relief valve 7, 7' and the outlet valve 6, 6' can be structurally combined into a single valve unit.

Although, in principle, the shape of the container can be chosen as desired, an elongated cylindrical shape for the pressure vessel is preferred for practical reasons. In accordance with FIGS. 1 to 4, an example of a cylindrical container 1 consists of a cylindrical pressure vessel 2, which has a gas-tight base 20 at a first end and is open at the second end. The second end preferably has an external thread 25, where a lower cover 4 can be screwed in a gas-tight manner by means of an internal thread onto the external thread 25. The pressure vessel 2 is filled with the tennis balls 21 through this second end.

An upper cover 3 is placed onto the base 20 at the first end of the pressure vessel 2. A pressure gauge 5, an outlet valve 6, and a pressure relief valve 7 are integrated into this cover 3 and are in connection with the pressure vessel 2, preferably via the base 20. A mechanical gas pump 8, consisting of a cylinder 26 and a piston 9, is peripherally disposed inside the pressure vessel 2. The mechanical gas pump 8 preferably operates like a manual bicycle pump, but alternatively the mechanical gas pump can be furnished as a piston pump with a suction valve and with a pressure valve. In such a situation the valve 24 of FIG. 1 would correspond to the pressure valve and to the suction valve, wherein the suctioning off would occur through the cylindrical space. In case of an air pump there is furnished a certain artificial leak between the piston and the cylinder wall around the piston or, respectively, is caused in case of a withdrawal of the piston and the air is sucked in between the piston wall and the cylinder wall. Alternatively, the piston of the air pump could include a suction valve, which would open up inside of the cylinder upon a presence of a certain underpressure during withdrawal of the piston and the suction valve would then allow a streaming in of air into the space in front of the piston.

Preferably, the gas pump extends in a direction parallel to the pressure vessel 2 and is disposed at a peripheral side of the pressure vessel 2. The upper end of the gas pump 8 pierces the base 20 of the pressure vessel 2 in a gas-tight manner and terminates within the upper cover 3. The piston 9 has a handle 10 at its upper end. The handle 10 serves to actuate the piston 9. The handle 10 is comparable to a manual handle at a bicycle pump. The piston 9 includes a piston rod connected to the handle 10 and a piston head which seals the area in front of the piston against the area behind the piston head against a passage of gas. The gas pump 8 has an inlet valve 24 at its lower end. The inlet valve 24 is provided to deliver compressed gas or air when the piston moves in a direction toward the inlet valve 24. The inlet valve 24 is closed when the piston 9 moves in a direction away from the inlet valve 24. The inlet valve 24 is arranged within the volume of the pressure vessel 2, i.e., the inlet valve 24, in its effect, acts into the pressure vessel 2. A suction valve is provided which is open when the piston moves away from the inlet valve 24 and which is closed when the piston moves toward the inlet valve 24. The suction valve is preferably located at the head of the piston 9 or at the end of the piston chamber confining the piston 9 on the side of the handle 10. A spring is provided between the handle 10 and the end of the gas chamber for preventing a direct impact of the handle 10 onto the gas chamber. The gas chamber of the pump 8 passes through the base 20. The gas chamber is sealed versus the interior of the cylindrical pressure vessel 2 and connected through the inlet valve 24 to the interior of the cylindrical pressure vessel 2. The length of the piston 9 is preferably longer than the diameter of the tennis balls times the number of tennis balls to be stored in the cylindrical pressure vessel.

The upper cover 3 includes a recess 11 in the region where the gas pump 8 passes through the cover 3, where the recess 11 is partially open towards the top in direction of the piston 9 and which, partly covered, extends peripherally along the jacket of the cover 3. The upwardly open part of the recess 11 serves to pull the piston 9 out of the cylinder 26 by means of the handle 10. The lengthwise peripheral part of the recess 11 that is covered from above serves to accommodate the handle 10 of the gas pump 8. To this end, the handle 10 exhibits the curvature of the cover 3 and can be swiveled around the axis of the piston 9 and, by means of a swiveling motion, the handle 10 can be swiveled out of the recess 11 and, after the pressure vessel 2 has been filled, it can be swiveled back into the recess 11. When the handle 10 is folded out of the recess 11, the handle 10 is preferably disposed swivelable by 90 degrees and has a detachable engaging device, such that the curvature of the handle is facing downwardly. Preferably, the radius of curvature of the handle surface is directed with one projected component upwardly for the lower handle surface. In this way, the handle lies ergonomically in the hand in order to carry out the pumping operation.

Figure 3:
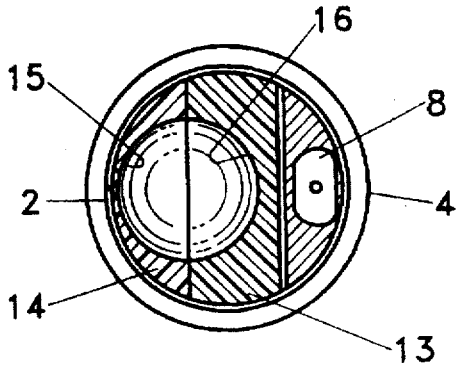
FIG. 3 is a cross-sectional view of the container along the section line 3—3 shown in FIG. 1.
Figure 4:
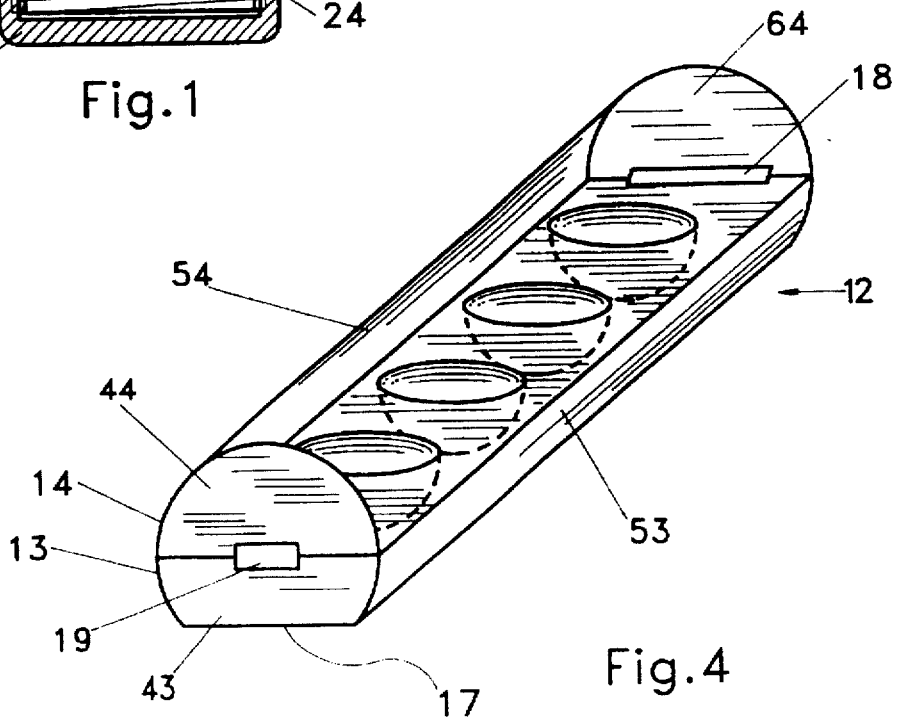
FIG. 4 is a perspective view of a receptacle for tennis balls inside a container.

A receptacle 12 is arranged inside the pressure vessel 2 in accordance with FIG. 4, where the receptacle has an elongated cylindrical shape, like the pressure vessel 2, and exhibits a segmental flattening 17 over the entire length. The space produced by the flattening 17 is taken up by the gas pump 8, as can be seen in FIG. 3. The receptacle 12 preferably consists of two parts 13 and 14, which can be swiveled at one end by means of a hinge 18 and can be locked at the other end by means of a closure 19. FIG. 4 shows the outer end wall face 44 of the form part 14, the outer end wall face 43 of the form part 13, and an outer side face 53 of the form part 13. In order to be able to recognize the position of the tennis balls 21 in FIG. 4, only the delimiting surfaces of the form part 14 are shown for the outer side face 54 and for the second outer end face 64. The hinge 18 is a so-called film hinge disposed between the two form parts 13, 14. The film hinge 18 is pressed at the time of the production of the form 12 in a single step and in a single form and the form parts 13, 14 are connected by this film hinge 18. The film hinge 18 serves the purpose that the two form parts 13, 14 are inseparable connected to each other and consequently cannot get lost individually. The form 12 according to FIG. 4 is furnished with an inlet valve quasi by a Joining slot, because always air can pass through the joining slot of the two half form parts 13 and 14. Hemispherical recesses 15, 16 are arranged in both parts 13, 14, where the two parts 13, 14 form together in each case a spherical recess serving to hold a tennis ball 21. The hemispherical recesses 15, 16 for receiving the tennis balls 21, 21' can be furnished with channels. In a manner that permits a gas flow, the individual recesses 15, 16 are connected with the volume of the pressure vessel 2 via channels 38, 39 or through the closing gap between the two parts 13, 14, so that gas, flowing in through the gas pump 8 and via the inlet valve 24, can spread inside the receptacle into all of the recesses 15, 16 of the receptacle 12. The inlet valve 24 is preferably also provided and also serves as a closure valve. The receptacle 12 or, respectively, the parts 13, 14 of the receptacle, consist of non-compressible or, respectively, compression-resistant, preferably closed-celled synthetic material or, respectively, foam so that the pressure built up in the pressure vessel does not diffuse into the receptacle, thus resulting in a slow drop in pressure after the build-up of the pressure. The size of the pressure vessel 2 and thus of the receptacle can preferably reflect the assumption that three or four tennis balls are to be held and it can vary to accommodate a plurality of tennis balls.

The receptacle shown in FIG. 4 shows overall the shape of a cylinder without a cylindrical section. The cylinder is composed of two cylindrical parts 13, 14 each having a surface adapted to match a corresponding surface of the other cylindrical part 14, 13 and which cylindrical parts 13, 14 form together the cylinder of the receptacle 12. The matching surfaces are preferably planar. A hinge 18 is disposed at a first end of the matching surfaces for holding the cylindrical parts 13, 14 together at all times. The opposite end of the matching surfaces is furnished with a locking mechanism 19 which, when locked, ensures that the two cylindrical parts 13, 14 are held together along the matching surfaces and form a cylindrical receptacle 12. The cylindrical parts 13, 14 are generally made of a space-filling material. The cylindrical parts are furnished with hollow spaces 15, 16 for positioning tennis balls. The hollow spaces are preferably disposed such that each of the cylindrical parts has a recess shaped as a hemisphere extending from the respective matching surface and where the hemispheres are disposed such as to form a sphere when the cylindrical parts 13, 14 are locked together with the locking mechanism 19. The size of the spheres corresponds preferably substantially to the sizes of the tennis balls to be maintained under pressure. Other configurations as compared to a spherical configuration are also conceivable. It is however necessary that the support surfaces for the tennis balls to be stored exhibit a radius of curvature which is from about one to two times the radius of the tennis ball in order to avoid deformation of the surfaces of the tennis balls during storage and regeneration.

The gas pump inside the container can also be operated electrically. In this case, the gas pump is preferably integrated into the upper cover as shown in FIG. 5.

Figure 5:
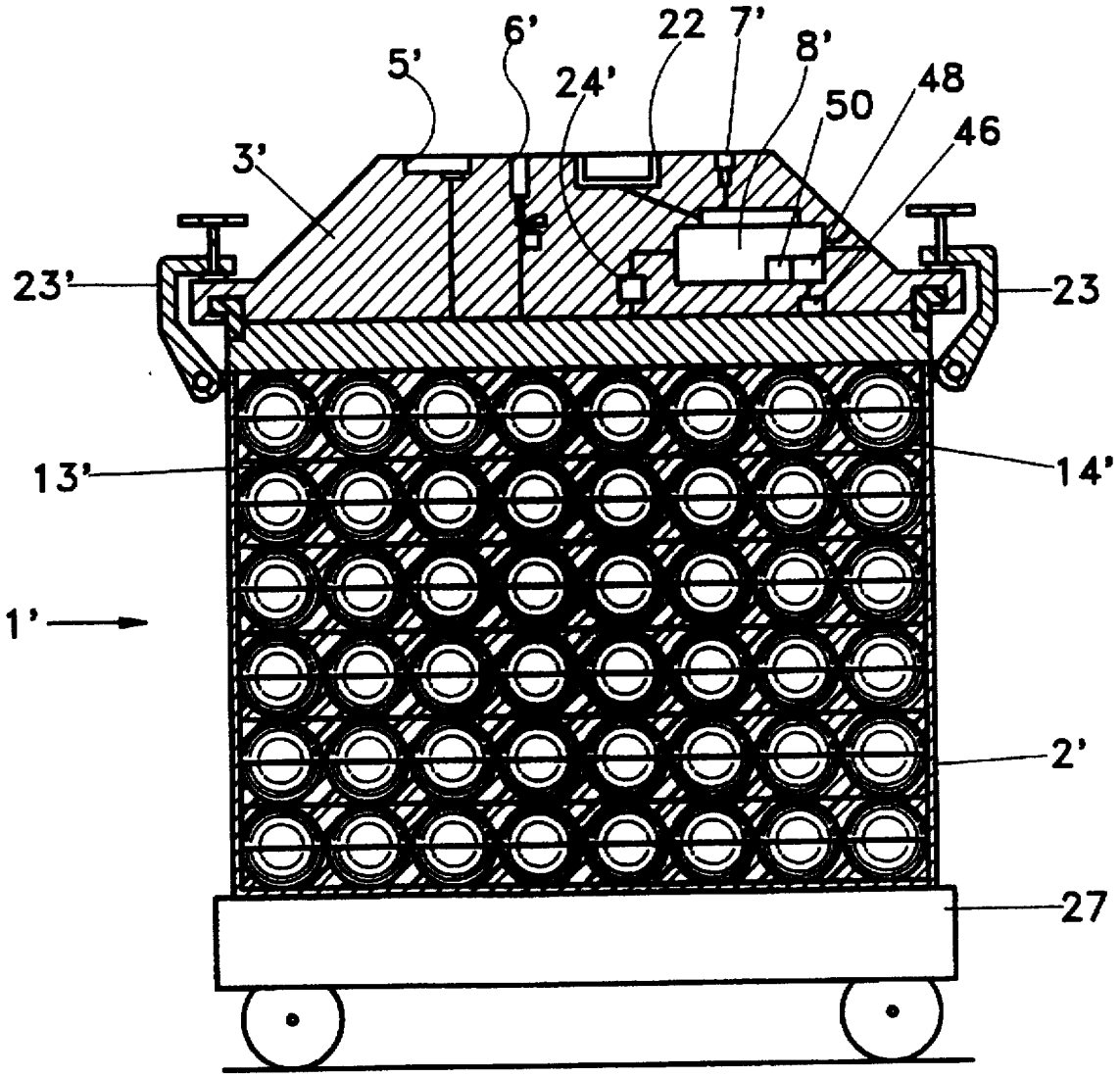
FIG. 5 is a view of a section through a mobile container for holding a fairly large number of tennis balls.

FIG. 5 shows an exemplified embodiment of a container 1' for the regeneration and storage of a plurality of tennis balls 21', whereby the pressure vessel 2' has a pot-like structure. A gas pump 8' is arranged inside a lid-like cover 3' of container 1'. The gas pump is preferably an electric pump and is connected with the volume of the pressure vessel 2' via an inlet valve 24'. An electrical motor 50 is connected to the gas pump and can be employed to drive the gas pump 8'. A controlled power supply 48 is connected to the electrical motor 50 and can be employed to drive the electrical motor 50. A sensor 46 is disposed in the cover 3', is connected to the controlled power supply 48 and is exposed to the gas volume inside the container 1'. When the sensor senses that the pressure inside of the container 1' has dropped to below a permissible value, then the electrical motor 50 and thereby the gas pump 8' are turned on to raise the pressure inside the container 1' to above a desired pressure value.

The cover 3' can be provided detachable and can be pressed in a gas-tight manner onto the pressure vessel 2' by means of claw-like clamps or grips 23, 23'. The shape of the vessel 2 is preferably cylindrical.

A plurality of layers of form parts 13', 14' are present inside the pressure vessel 2', where each layer 13', 14' can be shaped in accordance with the receptacles 12 of FIGS. 1 and 4. The form parts 13', 14' can be shaped corresponding to the form parts shown in FIG. 2, however with the difference that the outer shape of the form parts has an elongated parallelepipedal shape and which can exhibit in each case two parallel disposed rows of receiving spaces or receiving holes for tennis balls and not only a single row as illustrated in FIG. 4. The form parts 13', 14' can be comprised in each case of two halves, wherein a semi-spherical hole is disposed in each half for the receiving of the tennis balls and wherein the halves are such superposed that the semi-spherical shaped holes in the two halves are combining to complete ball shaped holes or hollow spaces. Each layer is capable of holding a plurality of tennis balls 1', as shown in FIG. 5. The layers are formed substantially of a bulk material preferably impermeable to gases. The bulk material is furnished with recesses. The recesses of adjacent layers are disposed opposite to each other for providing a hollow space for storing a tennis ball. Preferably, the recesses are of a semispherical shape and form a sphere when the layers are in an assembled position. The pressure vessel 2', together with the upper cover 3', is preferably placed on a mobile transporting rack 27. A possible alternative is an economical version of the container with receptacle with an inlet valve for connection to compressed air, whereby the receptacle can exhibit all of the embodiments described. Furthermore, compressed-air-like connection devices, equipped with shut-off valves, can be disposed at the container or at the pressure vessel in order to attach additional mobile pressure chambers.

Figure 6:
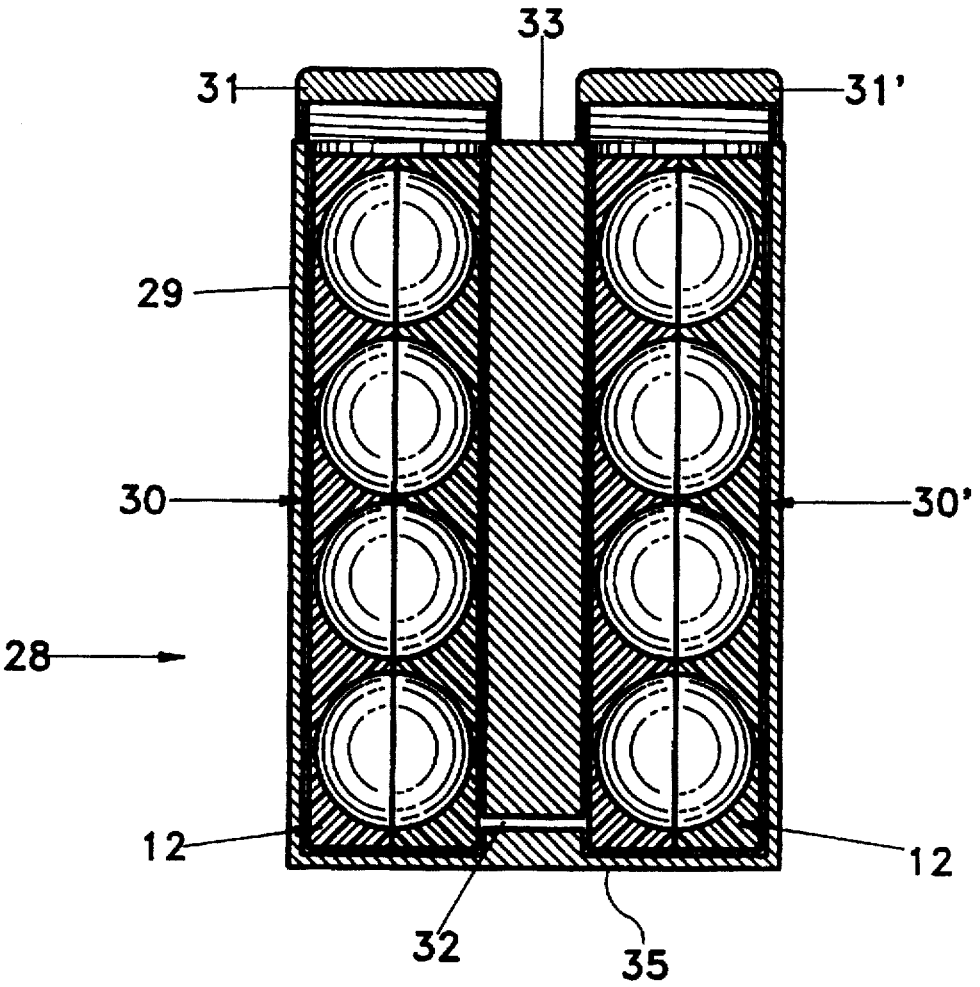
FIG. 6 is a view of a longitudinal section through a dual container with two chambers for holding eight tennis balls.
Figure 7:
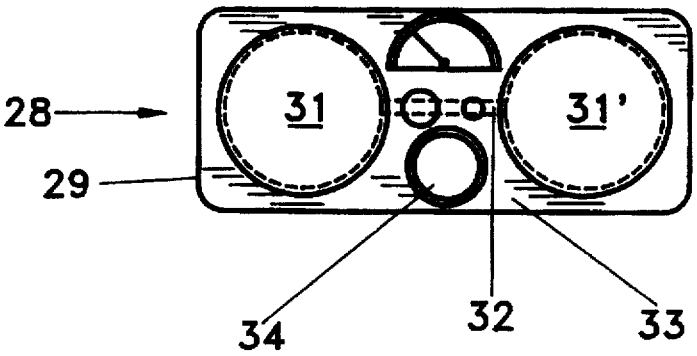
FIG. 7 is a top view onto the container shown in FIG. 6.
Figure 8:
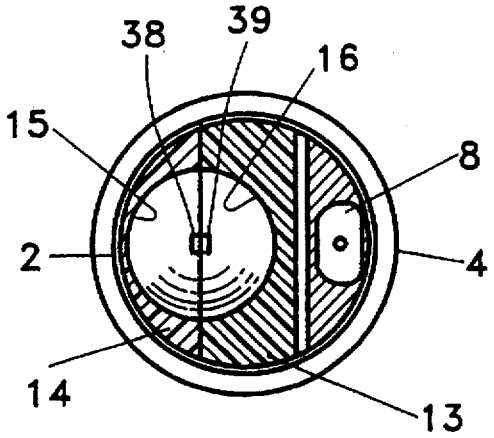
FIG. 8 is a cross-sectional view of the container along the section 3—3 to show another embodiment of a receptacle shown in FIG. 1.
Figure 9:
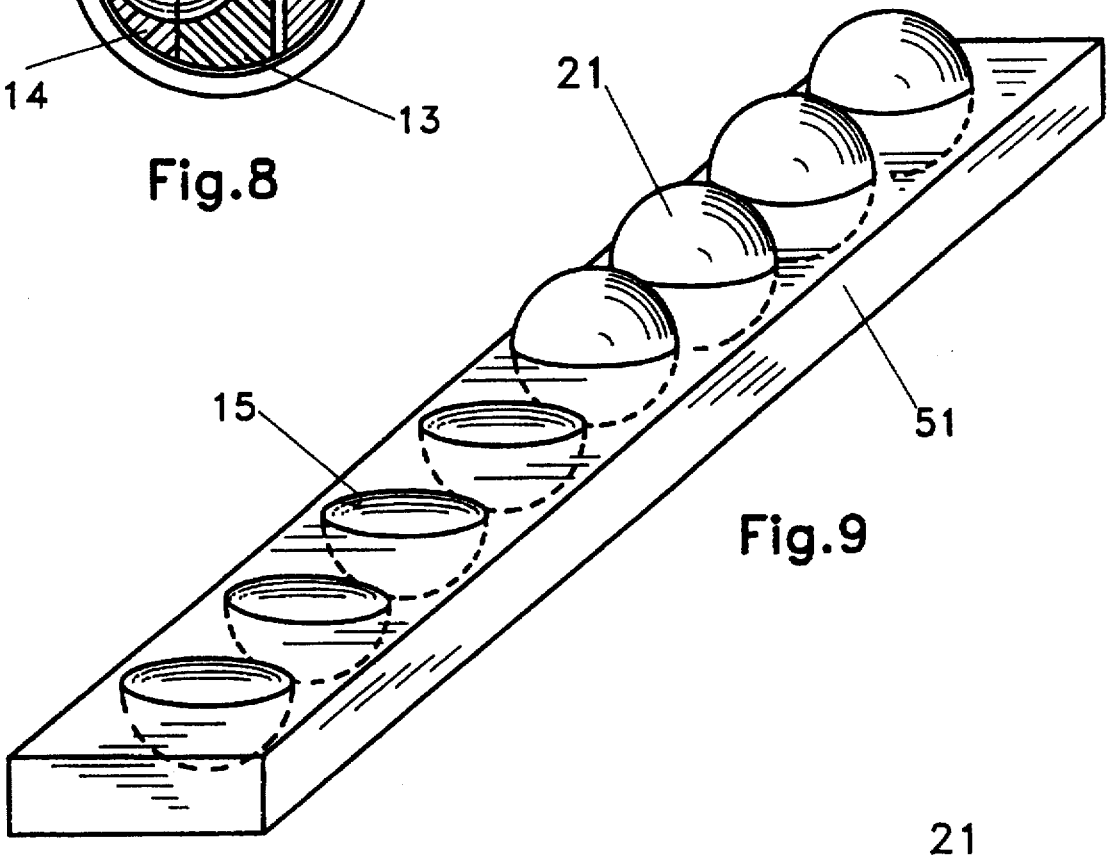
FIG. 9 is a view of one part of a further embodiment of a receptacle of the mobile container shown in FIG. 5.
Figure 10:
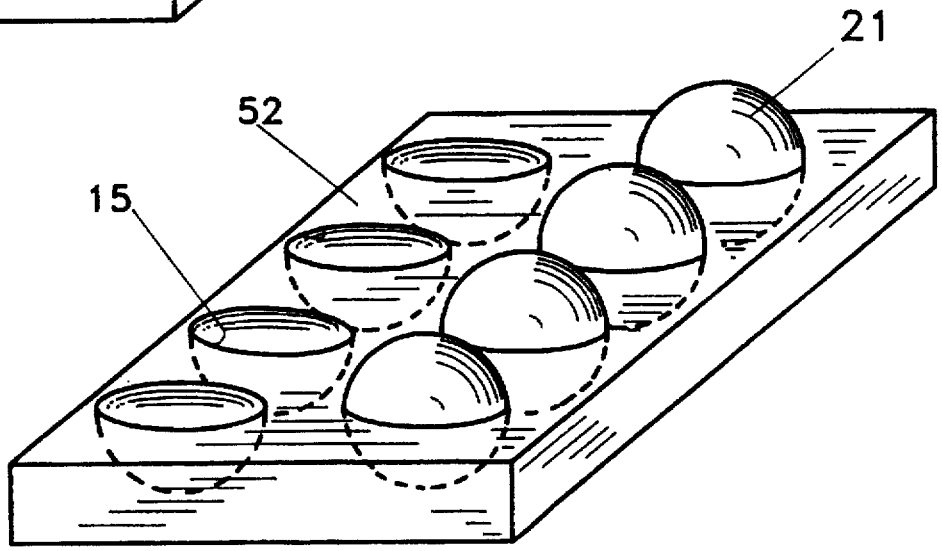
FIG. 10 is a view of one part of another embodiment of a receptacle of the mobile container shown in FIG. 5.
Figure 11:
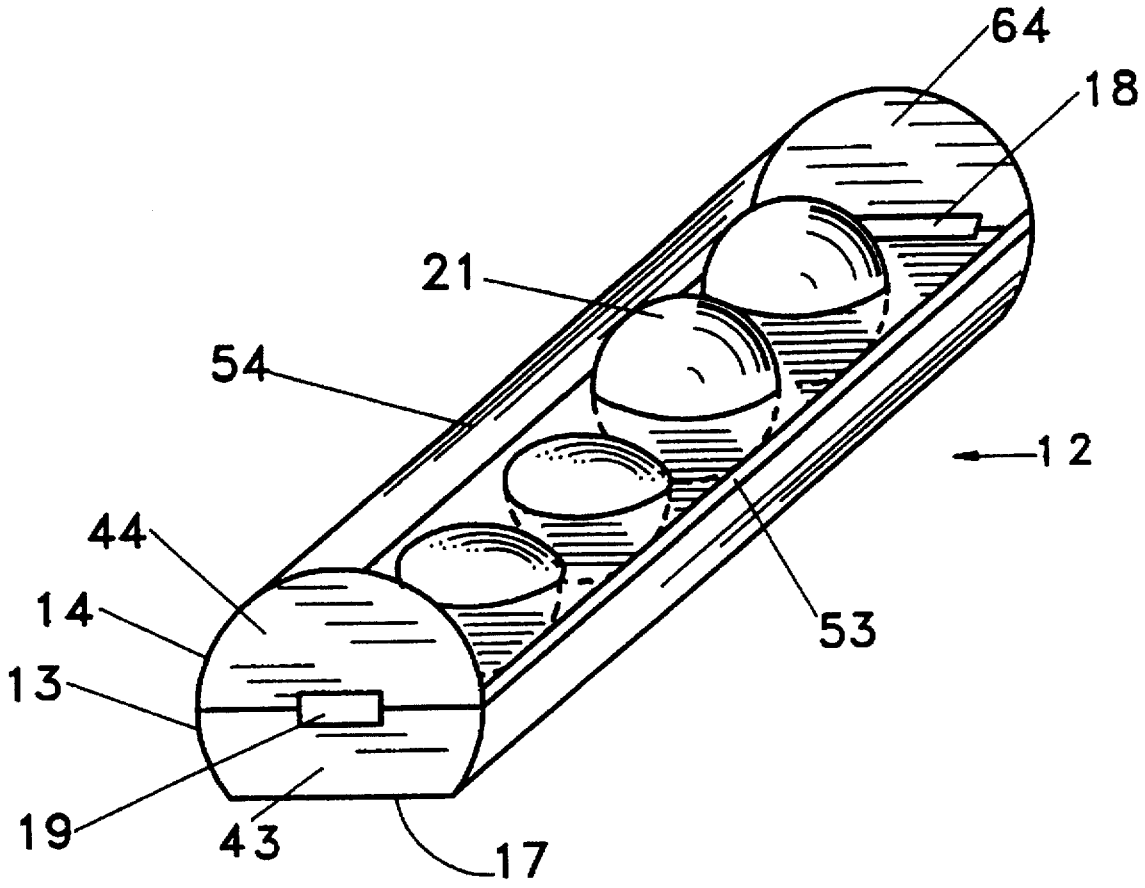
FIG. 11 is a view similar to FIG. 4 with a partial occupation of the recesses.

FIGS. 6 and 7 show another example of a pressure container 28 in accordance with the invention, where the pressure vessel 29 of the pressure container 28 has two chambers 30, 30'. The chambers 30, 30' communicate with one another with respect to the gas through a connecting channel 32. The chambers 30, 30' have a common base 35. Covers 31, 31' are provided with threads and are screwed onto the protruding upper ends of the chambers 30, 30', similar to the illustration in FIG. 1. A gas pump is integrated in the middle part 33 between the chambers 30, 30' or else inside of one of the chambers within the container 28. The gas pump is connected either with one of chambers 30, 30' or with the connecting channel 32. The other instruments of the container 28 are also integrated into the middle part 33. The container 28 can be a block in which three bores are made in accordance with the top view of FIG. 7, whereby the outer bores form the chambers 30, 30' and the middle bore forms the space for holding the gas pump. One receptacle 12 is arranged in each of the chambers 30, 30' and the receptacles can be completely cylindrical here. The receptacle 12 of FIG. 12 can have a cylindrical shape with a circular base, and the recesses forming spheres inside the receptacle 12 can have sphere centers which are disposed on the axis of the receptacle cylinder.

A pressure regulator 22 can be advantageously integrated into the upper cover 3, 3' of the container in addition to the pressure gauge 5, 5' as shown in FIG. 5. Both the pressure regulator 22 and the pressure gauge 5, 5' are connected with the pressure vessel 2, 2' of the container in order to maintain a constant specified pressure. The pressure regulator includes a pressure sensor, a comparator circuit connected to the pressure sensor and to a predetermined set pressure value, and an output signal line connected to the pressure pump 8. In case the pressure drops below a certain lower limiting value, the pressure pump is activated. If the pressure reaches a certain upper limiting value, then the pressure pump 8' is switched off. The pressure gauge and the pressure regulator can also be structurally integrated as a single measuring instrument. If, for example, the specified pressure is exceeded due to solar radiation, the air pressure is reduced via the pressure regulator. Alternatively, a pressure relief valve can be provided which discharges gas from the pressure vessel in case a second upper limiting pressure value is exceeded. If too little pressure is present in the container, a warning signal can be triggered in the Case of a mechanical pump. If an electric pump is present, the electric pump can reestablish the specified pressure. The pressure relief valve and the outlet valve and, if desired, the pressure regulator can be structurally combined into a single valve unit.

The invention can be advantageously applied in commerce for the regeneration and storage of tennis balls, such that they do not lose their internal pressure and/or that they retain their shape during their useful lifetime. The gas pump is associated directly with the container of the tennis balls and cannot be lost and, when disposed inside the container, the gas pump is protected to as great an extent as possible from damage from external impact forces.

It will be understood that each of the elements described above, or two or more together, may also find a nseful application in other types of containers and in connection with methods of regenerating and storing of tennis balls differing from the types described above.

While the invention has been illustrated and described as embodied in the context of a container with pressure vessel for the regeneration and storage of tennis balls, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A container with chambers for regeneration and storage of tennis balls under positive gas pressure comprising a base;

a pressure vessel closed at a base end by the base and having another end for easy opening and closing of the pressure vessel, wherein the base end and the other end represent a first end and a second end;

a cover disposed at the first end of the pressure vessel;

a pressure relief valve disposed in the cover and connected to the pressure vessel;

an outlet valve disposed in the cover and connected to the pressure vessel;

an inlet valve connected to the pressure vessel;

a gas pump attached to the inlet valve, wherein the gas pump is arranged in a structurally integrated manner, and wherein the gas pump generates a positive pressure of a gas;

a first detachable part having a first set of recesses and disposable in the pressure vessel;

a second detachable part having a second set of recesses and disposable in the pressure vessel, wherein the first detachable part and the second detachable part form a removable receptacle to be disposed inside of the pressure vessel, wherein the first set of recesses together with the second set of recesses form chambers of the receptacle, with each chamber having a size of a tennis ball for holding a plurality of tennis balls in the chambers inside of the receptacle, with individual tennis balls separated from each other, wherein said chambers are separated from each other, wherein means for communicating are provided connected to said chambers such that said chambers communicate with one another with respect to a gas, and wherein the positive pressure is applied through the chambers to the tennis balls.

2. The container according to claim 1, wherein the pressure vessel comprises two pressure chambers; further comprising a connecting channel connecting the two pressure chambers to each other, wherein the pressure chambers communicate through the connecting channel with respect to the gas, and wherein the gas pump is disposed between the two pressure chambers, and wherein the cover is provided as a pressure-tight cover for a first one of the two pressure chambers and further comprising a second pressure-tight cover for a second one of the two chambers.

3. The container according to claim 2, wherein the pressure vessel consists of a block with three bores, wherein two bores are designed as interconnected pressure chambers, and wherein the gas pump is integrated into the third bore.

4. The container according to claim 1, wherein the pressure vessel has a cylindrical shape, wherein the receptacle has a cylindrical shape, wherein the cylindrical shape of the receptacle exhibits a segmental flattening when viewed in a longitudinal direction, wherein the gas pump is integrated into the pressure vessel within an area defined by the segmental flattening, wherein the pressure vessel exhibits an opening in a downward direction at the other end, and wherein the pressure vessel is furnished with threads at its other end; further comprising a pressure-tight cover furnished with threads matching the threads of the pressure vessel, and wherein the opening of the pressure vessel is closable with a pressure-tight cover.

5. The container according to claim 1, wherein the gas pump comprises a piston and a cylinder, wherein the cylinder extends through the base of the pressure vessel in a gas-tight manner, and wherein the cylinder of the pump terminates in the cover; further comprising a recess disposed on the outer side of the cover;

a handle attached to the piston of the gas pump, wherein the handle is disposed swivelable around a piston axis, and wherein the handle is collapsible and is lowerable into the recess of the cover;

a pressure-tight cover for closing the other end of the pressure vessel.

6. The container according to claim 5, wherein the handle is swivelable by 90 degrees, when rotated out of the recess of the cover, and wherein the handle includes a disengageable locking device.

7. The container according to claim 1, further comprising an electric motor connected to the gas pump, wherein the gas pump is disposed within the cover of the container and wherein the cover is a gas-tight cover.

8. The container according to claim 1, further comprising a pressure gauge integrated into the cover of the container and connected to the pressure vessel of the container in order to maintain a constant specified pressure;

a pressure regulator integrated into the cover of the container and connected to the pressure vessel of the container in order to maintain a constant specified pressure.

9. The container according to claim 1, wherein the first detachable part is detached from the second detachable part, and wherein the receptacle is made of non-compressible plastic foam exhibiting closed cells.

10. The container according to claim 1, wherein the first detachable part and the second detachable part form a first layer, further comprising a second removable receptacle, wherein the second receptacle includes a first detachable part and a second detachable part, wherein the first detachable part of the second receptacle and the second detachable part of the second receptacle form a second layer, wherein the first layer and the second layer are stackable one above the other.

11. The container according to claim 1, further comprising connection devices equipped with shut-off valves and disposed at the pressure vessel for connecting mobile pressure chambers.

12. The container according to claim 1, wherein the pressure relief valve and the outlet valve are structurally combined into a single valve unit.

13. A container (1, 1', 28) comprising a pressure vessel for regeneration and storage of tennis balls (21, 21') under positive pressure of a gas, a base cover (3, 20, 35) and an easily opened and closed pressure-tight cover (3', 4, 31, 31'), a pressure relief valve (7, 7') as well as an outlet valve (6, 6') which are connected with a pressure vessel (2, 2') of the container (1, 1', 28), an inlet valve (24, 24'), as well as a gas pump (8, 8', 34) attachable to the inlet valve (24, 24'), wherein the gas pump (8) is integrated and disposed inside a container (1, 1' 28), wherein a removable receptacle (12) is disposed inside the pressure vessel (2), wherein the receptacle consists of several mutually detachable parts (13, 14), wherein recesses (15, 16) of the size of tennis balls (21, 21') for holding the balls separately from each other are disposed inside of the receptacle (12), wherein said recesses (15, 16) are separated from each other, but communicate with one another with respect to a gas through channels (32), wherein the recesses (14, 16) communicate with respect to the gas through channels (32) as well as through the inlet valve (24, 24'), and wherein the recesses (15, 16) extend over the parts (13, 14) of the receptacle (12), wherein the parts (13, 14) of the receptacle (12), when assembled, form the recesses (15, 16), and wherein the positive pressure of the gas can be applied through the recesses (15, 16) to the tennis balls (21, 21') with the gas pump (8, 8').

14. The container according to claim 13, wherein the pressure vessel (29) consists of at least two chambers (30, 30'), where said at least two chambers (30, 30') communicate with respect to the gas through a connecting channel (32), and wherein the gas pump (34) is arranged between said at least two chambers (30, 30') within the container (28).

15. The container according to claim 14, wherein the pressure vessel consists of a block with three bores, wherein two bores are designed as interconnected pressure chambers, and wherein the gas pump is integrated into the third bore.

16. The container according to claim 13, wherein the pressure vessel (2) and the receptacle (12) have cylindrical shapes which, in the longitudinal direction, exhibit a segmental flattening (17), wherein the gas pump (8) is integrated into the pressure vessel (2) within the flattening (17), wherein the pressure vessel (2) is open downwardly and can be closed by means of a pressure-tight cover (4), for which purpose the pressure vessel (2) and the cover (4) preferably have threads (25).

17. The container according to claim 13, wherein the gas pump (8) consists of a piston (9) with a cylinder (26), where the piston (9) passes through a base (20) of the pressure vessel (2) in a gas-tight manner and terminates in the base cover (3) of the container (1), and wherein the piston (9) of the gas pump (8) has a handle (10), wherein the handle (10) is disposed swivelable around a piston axis, and wherein the handle (10) is collapsible and can be lowered into a recess (11) within the base cover (3).

18. The container according to claim 17, wherein the handle (10) is swivelable by 90 degrees when folded out of the recess (11), and has a detachable engaging device.

19. The container according to claim 13, wherein the gas pump (8, 8') is operated electrically and is disposed within the base cover (3') of the container (1').

20. The container according to claim 13, wherein a pressure gauge (5, 5') and a pressure regulator (22) are integrated into the base cover (3, 3') of the container, and wherein the pressure gauge (5, 5') and the pressure regulator (22) are connected with the pressure vessel (2, 2') of the container in order to maintain a constant specified pressure.

21. The container according to claim 13, wherein the receptacle (12) is formed of two parts (13, 13', 14, 14') that can be detached from one another, and wherein the receptacle (12) is made of non-compressible, preferably closed-cell plastic foam.

22. The container according to claim 13, wherein the receptacle (12) consists of several layers (13', 14') which can be stacked one above the other, whereby each layer consists of at least two mutually detachable parts.

23. The container according to claim 13, wherein connection devices, equipped with shut-off valves, are disposed at the container or at the pressure vessel for a connection of additional mobile pressure chambers.

24. The container according to claim 13, wherein the pressure relief valve (7, 7') and the outlet valve (6, 6') are structurally combined into a single valve unit.

* * * * *